United States Patent [19]

Pretor et al.

[11] 4,293,248

[45] Oct. 6, 1981

[54] WALKING ROOF SUPPORT

[75] Inventors: Wincenty Pretor, Gliwice; Edward Rozmus, Katowice; Zbigniew Korecki, Gliwice; Stanislaw Karmański, Tarnowskie Gory, all of Poland

[73] Assignee: Centralny Osrodek Projektowo-Konstrukcyjny Maszyn Gorniczych "Komag", Gliwice, Poland

[21] Appl. No.: 13,312

[22] Filed: Feb. 21, 1979

[30] Foreign Application Priority Data

Feb. 23, 1978 [PL] Poland ..... 204847

[51] Int. Cl.[3] ..... E21D 23/08

[52] U.S. Cl. ..... 405/300

[58] Field of Search ..... 405/291, 299, 300; 91/170 MP; 299/31-33

[56] References Cited

U.S. PATENT DOCUMENTS

| | | | |
|---|---|---|---|
| 3,393,522 | 7/1968 | Fontein | 405/300 |
| 3,524,321 | 8/1970 | Wilkenloh et al. | 405/300 |
| 3,813,886 | 6/1974 | Alacchi | 405/300 X |

FOREIGN PATENT DOCUMENTS

| | | | |
|---|---|---|---|
| 1126821 | 4/1962 | Fed. Rep. of Germany | 405/300 |
| 1161834 | 1/1964 | Fed. Rep. of Germany | 405/300 |
| 61962 | 12/1970 | Poland . | |
| 72928 | 12/1974 | Poland . | |

*Primary Examiner*—David H. Corbin

*Attorney, Agent, or Firm*—Haseltine and Lake

[57] ABSTRACT

A walking roof support unit comprising first and second support assemblies disposed adjacent one another for being selectively spragged and released between the floor and the roof of a structure. Each support assembly includes a base, hydraulically operated first and second props extending vertically from the base in spaced parallel relation thereon and a roof beam supported on the props. The first and second support assemblies are coupled together for longitudinally advancing the assemblies step-wise and in sequence parallel to one another. The coupling between the assemblies includes a guide secured to the props of the first support assembly and a guide shoe slidably mounted on the guide for relative movement in the longitudinal direction. The guide has a longitudinal T-shaped slot and the guide shoe includes a longitudinal T-shaped projection slidably engaged in the slot. Two parallel transversely extending pull rods are respectively pivotably connected to the props of the second support assembly and to the guide shoe and an inclined pull rod is pivotably connected to one of the props of the second support assembly and to the guide shoe and extends diagonally between the two pull rods. A hyudraulic cylinder extends longitudinally and connects the guide and guide shoe for relatively displacing the same longitudinally.

3 Claims, 3 Drawing Figures

WALKING ROOF SUPPORT

FIELD OF THE INVENTION

The invention relates to a walking roof support comprising a base member and a roof supporting beam spragged between the floor and the roof by means of hydraulically operated props, coupled with the neighboring support by means of a unit for advancing the supports parallel to one another.

PRIOR ART

From the "Instructions of assembling, transport and logwall operation of a powered suspended support SOW-40" published by KOMAG-Gliwice in 1976, there is known a walking roof support comprising a unit for advancing the supports parallel to one another. The known roof support comprises hydraulic cylinders, each of which is fixed to each prop. The hydraulic cylinders are fixed at their other ends to the props of the neighboring supports. Moreover, in order to make the mechanism solid, the roof support is provided with an inclined pull rod extending between the neighboring supports, approximately along a line intersecting the front prop of one support and the rear prop of the neighboring support. When one support advances, the neighbouring support is spragged and does not move.

In consequence of the supports being advanced, the pull rods take an inclined position and their ends describe a curve, which makes the support being actually advanced come closer to the spragged one. To prevent the supports from coming closer to each other, the pull rods applied in the known support units are hydraulic power cylinders. The hydraulic cylinders are supplied with oil and due to this they are elongated, thus the support which is being advanced is pushed away from the spragged one at a previous distance.

A drawback of the known support unit is that it is difficult to set the hydraulic cylinders in the same position, and consequently, the neighboring supports occupy an inclined position in relation to one another, and come closer or move further away from one another.

SUMMARY OF THE INVENTION

An object of the invention is to provide a mining roof support comprising a unit for guiding the individual supports parallel to one another, and comprising pull rods coupling the neighboring supports and providing for a parallel position of the supports relative to each other after their advance.

The aforesaid object has been achieved due to the fact that the walking roof support is provided with a guide mounted in the props of one support and situated parallel to the advance direction.

The guide is connected with a guide shoe which is mounted slidably on the guide and moves in the direction of support advance. The guide shoe is coupled with the props of the neighboring support by means of two pull rods which are parallel to each other and situated transversely with respect to the direction of support advance.

The pull rods are articulated to the guide shoe and to the props of the neighboring support. Besides, the guide shoe is coupled through an inclined pull rod with the prop of the neighboring support, said inclined pull rod being disposed approximately along a line between the front prop of one support and the rear prop of the other support. The guide and the guide shoe are coupled with each other by means of a hydraulic cylinder which is fixed at one end to the guide shoe and is designed for shifting the guide shoe in relation to the guide. The guide shoe is preferably situated parallel to the advance direction.

BRIEF DESCRIPTION OF THE DRAWING

An embodiment of the invention is presented by way of example, with reference to the accompanying drawing, wherein.

DETAILED DESCRIPTION

Figure 1:
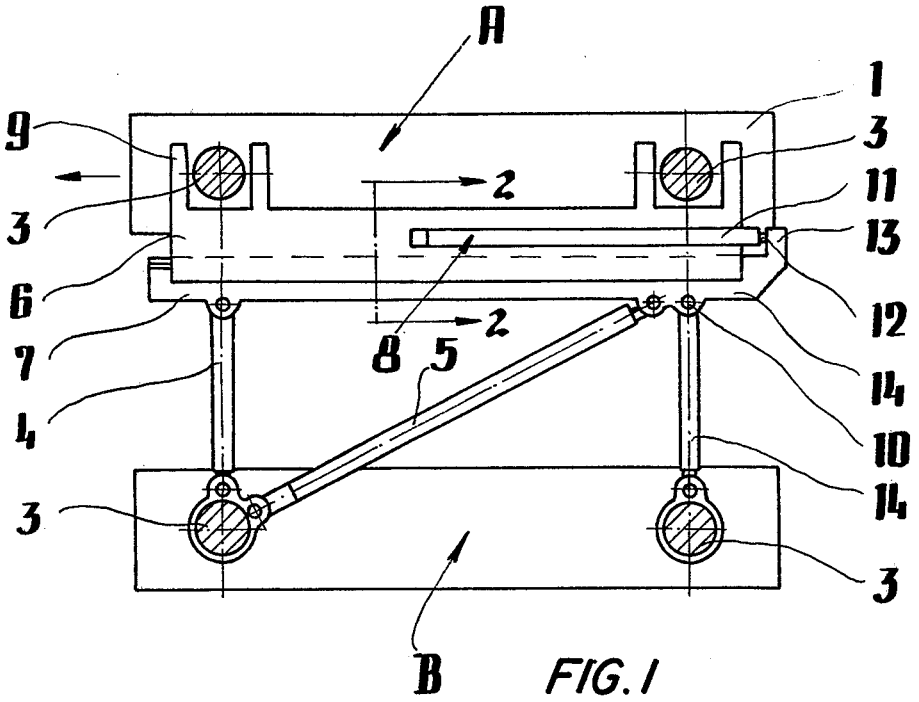
FIG. 1 is a horizontal sectional view taken through the roof supporting unit looking downwardly.
Figure 2:
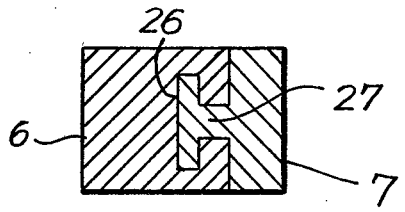
FIG. 2 is a sectional view taken along line 2—2 in FIG. 1.
Figure 3:
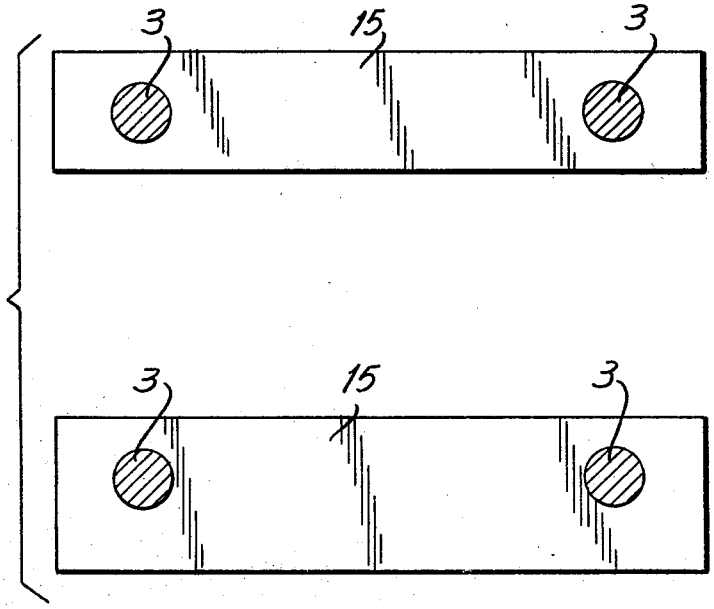
FIG. 3 is the same horizontal sectional view as in FIG. 1, but when looking upwardly, of the neighboring supports of the roof support unit, with their roof supporting beams broken away.

The walking roof support unit according to the invention consists of a series of supports disposed parallel to one another. An individual support comprises base members 1 and a roof supporting beam 15 which is shown in FIG. 2, spragged between the floor and the roof by means of hydraulically operated props 3. The support A of the walking roof support unit is coupled with the neighboring support B by means of a unit for advancing the supports in relation to each other, said unit being provided with a guide 6 mounted on the props 3 of the support A situated parallel to the advance direction. The guide 6 is provided with a guide shoe 7 which is mounted slidably on the guide and moves in the direction of support advance. More particularly, as shown in FIG. 2 the guide 6 is provided with a longitudinal T-shaped slot 26 in which a T-shaped end 27 on guide shoe 7 is slidably mounted. The guide shoe 7 is coupled with the hydraulically operated props 3 of the support B by means of two pull rods 4 extending parallel to each other and situated transversely in relation to the advance direction of the supports A and B. Additionally, the guide shoe 7 is connected with the hydraulically operated prop 3 of the support B by means of an inclined pull rod 5 which extends approximately along the line between the front prop 3 of the support B and the rear prop 3 of the support A. The guide shoe 7 and the guide 6 are coupled with each other by means of a hydraulic ram 8 which is fixed at one end to the guide 6 and the other end is fixed—by means of a pin 13—to an element 14 which is the end of the guide shoe 7.

In order to advance the support A whose props 3 are released from spragging, working liquid is supplied to the under-piston chamber of the hydraulic ram 8, which pushes the piston. Since a piston rod 12 is coupled with the prop 3 of the spragged support B by means of the guide shoe 7 and the inclined pull rod 5, i.e. it is coupled with the elements immobilized by the spragged support B, pressure which is exerted on the bottom of the cylinder 11 makes the cylinder move forward together with the guide 6 mounted on the props 3 of the support A. Thus, the guide 6 advances the support A. To advance the support B the props 3 of the support A are spragged between the floor and the roof, whereas the props 3 of the support B are released. Working liquid is supplied to an over-piston chamber, which causes the piston to be drawn, together with the piston rod, into the stationary cylinder 11 of the hydraulic ram 8. The piston rod 12 draws the guide shoe 7 which, sliding along the guide 6 and by means of the pull rod 4, shifts the support B to a new position. Mutual slidability of the guide 6 and the guide shoe 7 over a large contact surface, as well as an arrangement of pull rods 4 and 5, provide for parallelism of motion of the support A and B, in spite of any disturbances resulting from unevenness of the floor.

What is claimed is:

1. A walking roof support unit comprising first and second support means disposed adjacent one another for being selectively spragged and released between the floor and the roof of a structure, each support means including a base, hydraulically operated first and second props extending vertically from said base in spaced parallel relation thereon, and a roof beam supported on said props, and coupling means connecting said first and second support means for longitudinally advancing said first and second support means stepwise and in sequence parallel to one another, said coupling means comprising a guide secured to the props of the first support means, a guide shoe slidably mounted on said guide for relative movement in the longitudinal direction, said guide having a longitudinal T-shaped slot and said guide shoe including a longitudinal T-shaped end slidably engaged in said slot, two parallel, transversely extending pull rods respectively pivotably connected to the props of the second support means and to said guide shoe, an inclined pull rod pivotably connected to one of the props of said second support means and to said guide shoe and extending diagonally between said two pull rods, and a longitudinally extending hydraulic cylinder means connecting said guide and guide shoe for relatively displacing the same longitudinally.

2. A walking roof support unit as claimed in claim 1 wherein said inclined pull rod extends from the front prop of said second support means along a line directed towards the rear prop of the first support means.

3. A walking roof support unit as claimed in claim 2 wherein said hydraulic cylinder means comprises a piston secured to said guide shoe which is slidable in a cylinder secured to said guide.

* * * * *